United States Patent [19]

Kawase et al.

[11] 3,984,600

[45] Oct. 5, 1976

[54] ZIP FASTENERS MADE OF POLYESTER MONOFILAMENTS

[75] Inventors: Shoji Kawase; Takatoshi Kuratsuji, both of Iwakuni, Japan

[73] Assignee: Teijin Limited, Osaka, Japan

[22] Filed: July 15, 1975

[21] Appl. No.: 596,188

[30] Foreign Application Priority Data

July 15, 1974 Japan ..... 49-80189
Mar. 26, 1975 Japan ..... 50-35622

[52] U.S. Cl. ..... 428/364; 24/201 R; 24/205 R; 264/210 F; 428/395

[51] Int. Cl.[2] ..... A44B 19/00; D02G 3/00

[58] Field of Search ..... 428/395, 364; 264/210 F, 252; 24/201, 203, 204, 205, 1

[56] References Cited

UNITED STATES PATENTS

| | | | |
|---|---|---|---|
| 2,465,319 | 3/1949 | Whinfield | 264/210 F |
| 3,069,723 | 12/1962 | Porepp | 264/252 X |
| 3,584,103 | 6/1971 | Harris | 264/210 F |
| 3,621,088 | 11/1971 | Hatcher | 264/210 F X |
| 3,822,334 | 7/1974 | Patterson | 264/210 F |

FOREIGN PATENTS OR APPLICATIONS

| | | | |
|---|---|---|---|
| 130,609 | 12/1948 | Australia | 264/252 |

*Primary Examiner*—Lorraine T. Kendell
*Attorney, Agent, or Firm*—Sherman & Shalloway

[57] ABSTRACT

A zip fastener made of a monofilament of 200 to 20,000 denier composed of a polymethylene terephthalate containing at least 85 mole % of trimethylene terephthalate, tetramethylene terephthalate or hexamethylene terephthalate as a recurring unit, said monofilament having an intrinsic viscosity of 0.35 to 3.5 and a circularity of not more than 1.01. The monofilament is prepared by melt-extruding the polymethylene terephthalate in the form of a filament, passing the extruded filament through an air gap, passing it through a cooling bath of an inert quenching liquid held at a temperature of about 60° to 100°C., then passing it through a cooling zone at a temperature of below 35°C., and then drawing the filament.

2 Claims, No Drawings

ZIP FASTENERS MADE OF POLYESTER MONOFILAMENTS

This invention relates to a zip fastener, and more specifically, to a zip fastener made of monofilaments of polytrimethylene terephthalate, polytetramethylene terephthalate or polyhexamethylene terephthalate.

Zip fasteners made of monofilaments of a polymer such as polyacetal, polyethylene terephthalate or nylon have been known heretofore. These materials, however, pose various problems. For example, polyacetal decomposes during melt-shaping to generate a toxic gas of formaldehyde, and greatly pollutes the working environment. Thus, its improvement has been desired. Nylon, on the other hand, has high water absorption, and its decomposition is accelerated during melt-shaping because of moisture. Accordingly, the moisture content of nylon during the operation must be strictly controlled. Furthermore, these materials do not necessarily show satisfactory durability. Fasteners made of polyethylene terephthalate monofilaments have lower shrinkage than nylon, but have a poor interlockability which has frequently led to troubles in end uses.

We have now found that polytrimethylene terephthalate, polytetramethylene terephthalate and polyhexamethylene terephthalate (the three polymers may be referred to generically as "polymethylene terephthalate" hereinbelow) can be used as materials for zip fasteners without involving the above-mentioned defects.

Polymethylene terephthalates, however, have the defect that their second order transition point is low, and they are susceptible to deformation at relatively low temperatures. Thus, in order to cause the circularity value of asspun monofilaments from these polymers to be near 1, the temperature of a cooling bath must be elevated. Polyethylene terephthalate monofilaments have a high second order transition point and therefore, will readily cool to a temperature below the second order transition point before they reach wind-up rollers. In contrast, since polymethylene terephthalate monofilaments have a second order transition point near room temperature, it is difficult to allow them to cool to a temperature below the second order transition point. Accordingly, the monofilaments of polymethylene terephthalate deform upon contact with a solid object such as a guide after they have left the cooling bath. This deformation could be prevented if the temperature of the cooling bath is lowered. However, this results in the fast solidification of the surface of the monofilaments and the retarded solidification of their internal portion. Thus, the crystallinity of the monofilaments differs between the surface and the internal portion. This means that the central portion shrinks and raised and depressed portions occur on the surface, and therefore, the circularity value of the monofilaments increases. Zip fasteners made of monofilaments having a large circularity value are liable to break since they undergo high resistance at the time of sliding a tab or carrier strip.

The "circularity", as used herein, is defined as the ratio of the larger diameter to the shorter diameter of the transverse cross-section of a monofilament. When the circularity value approaches 1, the cross-sectional shape of the monofilament approaches a circle.

Accordingly, it is an object of this invention to prepare monofilaments having a circularity value of near 1 from polymethylene terephthalates, and to provide zip fastners made of such monofilaments.

We have found that the monofilaments as intended by this invention can be obtained by melt-extruding the polymethylene terephthalate, and primarily cooling the extruded filament in a cooling bath held at a temperature of 60° to 100° C., cooling it secondarily to a temperature of not more than 35° C. before it makes contact with a solid object such as a guide, and thereafter drawing the cooled filament.

Thus, according to this invention, there is provided a process which comprises melt-extruding a polymethylene terephthalate containing at least 85 mole% of trimethylene terephthalate, tetramethylene terephthalate or hexamethylene terephthalate as a recurring unit in the form of a filament passing the extruded filament through an air gap, passing it through a cooling bath of an inert quenching liquid held at a temperature of about 60° to about 100° C., then passing it through a cooling zone at a temperature of below 35° C., and then drawing the filament.

Zip fastners of this invention can be made by processing the monofilaments so obtained having a denier size of 200 to 20,000, an intrinsic viscosity of 0.35 to 3.5 and a circularity of not more than 1.01 in a customary manner.

The polymethylene terephthalates as a starting material of this invention can be synthesized by reacting trimethylene glycol, tetramethylene glycol, hexamethylene glycol or functional derivatives of these with terephthalic acid or its functional derivatives in the presence, if desired, of a suitable catalyst. In the preparation of the polymethylene terephthalates, a small amount (usually not more than 15 mole%) of a third component may be copolymerized therewith before the completion of the polymerization. Examples of suitable third components are dicarboxylic acids such as isophthalic acid, naphthalenedicarboxylic acid, dichloroterephthalic acid, dibromoterephthalic acid, 5-sodiumsulfoisophthalic acid, 2-methylterephthalic acid, 4-methylisophthalic acid, diphenyldicarboxylic acid, diphenyletherdicarboxylic acid, diphenylsulfonedicarboxylic acid, diphenoxyethanedicaboxylic acid, adipic acid, and sebacic acid, and functional derivatives of these; hydroxy acids such as p-β-hydroxyethoxybenzoic acid and their functional derivatives; and dihydroxy compounds such as ethylene glycol, diethylene glycol, neopentylene glycol, propylene glycol, decamethylene glycol, cyclohexanedimethanol, hydroquinone, bis (β-hydroxyethoxy) benzene, bisphenol A, di-p-hydroxyphenylsulfone, 2,2-bis(β-hydroxyethoxyphenyl) propane, di-p-(β-hydroxyethoxy) phenylsulfone, polyoxyethylene glycol, polyoxypropylene glycol, and polyoxytetramethylene glycol, and their functional derivatives. There can also be added compounds containing at least 3 ester-forming functional groups such as glycerol, pentaerythritol, trimethylol propane, trimellitic acid, trimesic acid or pyromellitic acid in an amount within such a range as to maintain the resulting polymer substantially linear. Suitable amounts of monofunctional compounds such as benzoic acid or naphthoic acid can also be added in order to adjust the degree of polymerization or the viscosity of the polymer.

If desired, the polymethylene terephthalates may contain various additives, for example, a delusterant such as titanium dioxide, a stabilizer such as phosphoric acid, phosphorous acid, phosphonic acid, or esters of these, an ultraviolet absorber such as benzophenone derivatives or benzotriazole derivatives, an anti-oxidant, a fire retardant, a slipping agent, a coloring agent, and a filler.

The degree of polymerization of polymethylene terephthalate as a starting material can be suitably chosen so that the intrinsic viscosity, as measured on an orthochlorophenol solution at 35° C., of the resulting monofilaments is 0.35 to 3.5, preferably 0.40 to 3.5 more preferably 0.6 to 2.0. Monofilaments having an intrinsic viscosity of less than 0.35 are brittle and do not find practical utility, and monofilaments having an intrinsic viscosity of above 3.5 are difficult to mold. Thus, these monofilaments are both outside the scope of the present invention.

Since the air gap which is the distance between the extrusion opening of the spinneret and the liquid surface of the cooling bath is irrelevant to the circularity of the monofilaments, there is no particular restriction on it. However, when the air gap is too large or too small, there will be greater non-uniformity in the diameter of the filaments in the longitudinal direction. Therefore, the preferred air gap is about 50 to 350 mm.

The cooling bath is a bath of an inert liquid for cooling the extruded filaments. Examples of the inert liquid are water, aqueous solutions of inorganic salts, ethylene glycol, polyalkylene glycols, glycerol, and silicone oil. Of these, the aqueous solutions of inorganic salts, for example, and aqueous solution of an alkali metal salt such as potassium chloride, potassium nitrate, sodium chloride, or sodium nitrate, are especially useful because of their superior heat-exchanging capacity. These inert liquids adhering to the filaments are washed easily with water.

It is necessary that the temperature of the cooling bath is 60° to 100° C. When the temperature of the cooling bath is less than 60° C., only the surface of the filaments is rapidly cooled and solidified, and when the entire filaments have been cooled, irregular depressed and raised portions appear on the surface. As a result, the circularity value of the filaments increases. When the temperature of the cooling bath exceeds 100° C., crystallization proceeds simultaneously with solidification to afford undrawn filaments having poor drawability. The preferred temperature of the cooling bath is 65° to 98° C., more preferably 70° to 95° C. The preferred depth of the cooling bath is 90 to 120 cm.

In the process of this invention, the filaments leaving the cooling bath maintained at the temperature specified above need to be cooled before they make contact with a solid object, for example, a guide such as a hook, reel or roller, so that the temperature of the filament surface becomes not more than 35° C. Since too low surface temperatures may cause cracke in the filaments, cooling to below −5° C. should better be avoided. The preferred cooling temperature is 1° to 30° C.

The filaments which have left the cooling bath are usually wound up via a solid guide. Polyethylene terephthalate filaments can be directly wound up without any effect on their circularity. However, the polymethylene terephthalate filaments deform on contact with a solid guide because of their second order transition point, and their circularity deviates greatly from 1. This is why the filaments must be secondarily cooled to a temperature of not more than 35° C. after they have left the cooling bath for primary cooling and before they make contact with solid objects.

The secondary cooling can be accomplished by any desired methods, such as the spraying of a cooling gas, the pouring of a cooling liquid, or the passing of the filaments through a cooled atmosphere. The cooling gases and liquids are preferably those which are inert to polymethylene terephthalates, and include, for example, air, nitrogen, carbon dioxide gas, water, aqueous solutions of inorganic salts, ethylene glycol, polyalkylene glycols, and glycerol. The site of the secondary cooling is any point in space between the exit of the cooling bath and a solid object with which the filaments may first make contact. In some case, the filaments can be cooled on the solid object.

The time for the secondary cooling varies according to the type or temperature of the cooling medium, but usually, periods of at least about 0.5 second are sufficient. The cooling can be performed several times.

In the process of this invention, the undrawn polymethylene terephthalate monofilaments which have been secondarily cooled are then drawn in a customary manner. The filaments are drawn in one or a multiple of stages at a temperature of, for example, 30° to 150° C., and especially 60° to 150° C. (when the filaments are of polytetramethylene terephthalate), and then, subjected to a restricted shrinkage heat-treatment by 2 to 15% in a non-contacting condition in a heated air bath held at 300° to 400° C. to adjust the total draw ratio to 2.5 to 6.0.

The above-described procedure affords mono-filaments composed of a polymethylene terephthalate containing at least 85 mole% of trimethylene terephthalate, tetramethylene terephthalate or hexamethylene terephthalate as a recurring unit, and having a denier size of 200 to 20,000 denier, preferably 500 to 20,000 denier, an intrinsic viscosity of 0.35 to 3.5, preferably 0.6 to 2.0, and a circularity of not more than 1.01.

The zip fastners of this invention can be easily produced in a customary manner using these monofilaments. For example, as shown in Example 2 given hereinbelow, elements for zip fasteners heat-set in a zig-zag or coiled form are prepared, and then as shown in Example 3 given hereinbelow, a pair of such elements are combined with a carrier strip so that the desired width and height of tooth head are obtained, thereby to make the desired zip fasteners.

Polymethylene terephthalates have very low hygroscopicity as compared with polyethylene terephthalate, and for example, the moisture absorption of polytetramethylene terephthalate is 0.4% by weight which is about half of that of polyethylene terephthalate. Furthermore, the polymethylene terephthalates have a relatively low Young's modulus. For example, the Young's modulus of polytetramethylene terephthalate is about 250 Kg/mm$^2$ which is about the same as that of nylon 6 and is about one-fourth of that of polyethylene terephthalate. Furthermore, the polymethylene terephthalates have high elastic recovery, and for example, the elastic recovery of polytetramethylene terephthalate from 5% strain is 90% which is substantially comparable to that of nylon 6 (92%). These properties of the polymethylene terephthalates are very favorable properties for zip fasteners. Accordingly, the zip fasteners of this invention made of monofilaments of polymethylene terephthalates have superior properties not seen in the conventional zip fasteners made of polymers because of the above-mentioned suitable properties of the polymer material itself and also because the circularity value of the monofilaments is very near 1.

Generally, the zip fasteners of this invention are little affected by moisture and flexible and have superior interlockability and abrasion resistance. They exhibit a use life about 50% longer than the conventional zip fasteners.

The following non-limitative Examples illustrate the present invention.

EXAMPLE 1

Polytetramethylene terephthalate having an intrinsic viscosity of 1.05 was melted at 280° C., and spun at a feed of 89 g/min. from a spinneret having one extrusion orifice with a diameter of 1.5 mm. The distance (air gap) between the liquid surface of a cooling bath and the extrusion orifice of the spinneret was adjusted to 100 mm, and the temperature of the cooling bath was maintained at 90° C. At the exit of the cooling bath, cooling water at 15° C. was poured onto the filament for secondary cooling. The filament was passed through a reel, and wound up at a rate of 75 meters/-min. to form an undrawn filament having a denier size of 10,700. The undrawn filament was drawn in two stages, and subjected to a restricted shrinkage heat-treatment. There was obtained a drawn monofilament with a total draw ratio of 4.31, an intrinsic viscosity of 1.00, a denier size of 2,480, and a circularity of 1.002 (this filament will be referred to as monofilament A).

Monofilaments B, C, D, E, F and G were prepared from various polymers in the same manner as above except that the spinning and drawing conditions were varied.

The operational details and the results are shown in Table 1.

Table 1

| Monofilament | Polymer | Intrinsic viscosity [η] of the polymer | Spinning and drawing conditions: Orifice diameter (mm) | Spinning temp. (°C) | Spinning feed (g/min) | Temp. of the cooling bath (C°) | Air gap (mm) | Secondary cooling temp. (°C) | Wind-up speed (m/min) | Denier size of the undrawn filament (de) | Total draw ratio | Properties of monofilaments: Intrinsic viscosity [η] | Denier size (de) | Circularity |
|---|---|---|---|---|---|---|---|---|---|---|---|---|---|---|
| A | $C_4T$[1] | 1.05 | 1.5 | 280 | 89 | 90 | 100 | 15 | 75 | 10700 | 4.31 | 1.00 | 2480 | 1.002 |
| B[5] | $C_4T$[1] | 1.05 | 1.5 | 280 | 89 | 50 | 100 | 50 | 75 | 10700 | 4.31 | 1.00 | 2480 | 1.025 |
| C | $C_4T$[1] | 0.80 | 1.5 | 275 | 106.5 | 90 | 100 | 20 | 80 | 11980 | 4.82 | 0.75 | 2480 | 1.003 |
| D[6] | $C_4T$[1] | 0.34 | 1.5 | 275 | 106.5 | 90 | 100 | 20 | 80 | 11980 | 4.82 | 0.30 | 2480 | 1.005 |
| E | $C_3T$[2] | 1.25 | 1.5 | 270 | 89 | 85 | 100 | 20 | 75 | 10700 | 4.25 | 1.18 | 2520 | 1.003 |
| F | $C_6T$[3] | 1.40 | 1.5 | 220 | 89 | 65 | 100 | 15 | 75 | 10700 | 4.37 | 1.25 | 2440 | 1.005 |
| G[7] | $C_2T$[4] | 0.65 | 1.5 | 300 | 93.6 | 90 | 100 | 90 | 80 | 10520 | 4.19 | 0.62 | 2510 | 1.003 |

[1]Polytetramethylene terephthalate
[2]Polytrimethylene terephthalate
[3]Polyhexamethylene terephthalate
[4]Polydimethylene terephthalate (Polyethylene terephthalate)
[5]Control example (the secondary cooling was not done)
[6]Control example (the monofilament has an intrinsic viscosity of less than 0.35)
[7]Control example (the polymer was outside the scope of this invention)

EXAMPLE 2

Monofilament A was wound around a mandrel heated at 90° C., and the resulting curved monofilament was flattened by pressing it from a direction at right angles to the helical center line and heat-set at 120° C. for 5 seconds. A coil-type element for zip fastener A having a pitch of 1.06 mm and a bulge of 0.80 was thus formed.

In the same manner as above except that the molding conditions were changed as shown in Table 2, elements for zip fasteners B, D, E, F and G having the same pitch and bulge as the fastener A were produced from monofilaments B, D, E, F and G.

Monofilament C was fed to a disc heated at 90° C. and equipped with a traverse and molded into a zig-zag form with a path of 5.2 mm and a pitch of 2.1 mm. The resulting zig-zag-type monofilament was bended with its center line as an axis, and heat-set at 120° C. for 5 seconds. A zig-zag-type element for zip fastener C having a pitch of 1.06 mm and a bulge of 0.80 mm was thus formed.

The number of filament breakages and the percent shrinkage of the filament during the molding of these elements for zip fasteners were measured. The results are shown in Table 2.

Table 2

| Element | Molding conditions: Temp. of the mandrel or disc (°C) | Heat-setting: Temp. (°C) | Heat-setting: Time (sec.) | Type of element | Number of filament breakages (times/hour) | Shrinkage of the filament (%) |
|---|---|---|---|---|---|---|
| A | 90 | 120 | 5 | coil | 0 | 2 |
| B* | 90 | 120 | 5 | coil | 0 | 2 |
| C | 90 | 120 | 5 | zig-zag coil | 0 | 2 |
| D* | 90 | 120 | 5 | coil | 1 | 2 |
| E | 30 | 120 | 5 | coil | 0 | 2 |
| F | 60 | 110 | 3 | coil | 0 | 2 |
| G* | 90 | 150 | 10 | coil | 1 | 8 |

*Control examples

These data demonstrate that according to this invention, elements for zip fasteners can be made from monofilaments at low temperatures within short periods of time without causing breakage and great shrinkage to the filaments.

EXAMPLE 3

The elements A, B, C. D, E, F and G obtained in Example 2 were each sewn to carrier strips so that zip fasteners with a width of 4.1 mm and a height of tooth head of 1.45 mm were formed. The resulting zip fasteners A, B, C, D, E, F and G were each dyed with a disperse dye (Fast Scarlet B) under the conditions shown in Table 3. The results obtained are shown also in Table 3.

Table 3

| Zip fastener | Dyeing conditions: Temperature (°C) | Pressure | Time (minutes) | Dye exhaustion (%) |
|---|---|---|---|---|
| A | 100 | Atmospheric | 60 | 85 |
| B* | 100 | Atmospheric | 60 | 85 |
| C | 100 | Atmospheric | 60 | 85 |
| D* | 100 | Atmospheric | 60 | 85 |
| E | 100 | Atmospheric | 60 | 86 |
| F | 100 | Atmospheric | 60 | 87 |
| G* | 130 | High (steam) | 60 | 80 |
| G* | 100 | Atmospheric | 90 | 50 |

*Control examples

The above data demonstrate that while the conventional zip fastener composed of polyethylene terephthalate is not dyed unless subjected to high temperatures and pressures, the zip fasteners of this invention composed of poly(tri, tetra, or hexa)methylene terephthalate can be dyed satisfactorily by an easy dyeing operation.

EXAMPLE 4

A use test was performed on each of the zip fasteners obtained in Example 3. In this test, 20 of each zip fastener were tested. They were repeatedly opened and closed 10,000 times (10,000 opening-closing cycles), and the number of fasteners which became useless as a result of deformation or wearing were recorded. The results are shown in Table 4.

Table 4

| Zip fastener | Number of useless fasteners | Observation |
|---|---|---|
| A | 0 | No problem at all |
| B[1] | 3 | The number of breakage is large because the circularity of the monofilament is large and there is a high resistance at the time of opening and closing. |
| C | 0.5 | No problem at all |
| D[1] | 3 | The number of breakages is large because the monofilament has a low intrinsic viscosity and thus is brittle and weak to impact. |
| E | 0 | Even when the strain is large, the recovery to the original state is satisfactory; therefore, no problem |
| F | 1 | No problem at all |
| G[1] | 3 | Even a slight strain, the original state cannot be recovered completely, and gradually the deformation becomes greater, frequently leading to breakage |
| Nylon 6[2] | 4 | Much breakage because of the elongation at the time of opening and closing |

[1]Control examples
[2]a control example (a commercially available zip fastener of coil type made of a nylon 6 monofilament having an intrinsic viscosity of 1.10, a denier size of 2,500 and a circularity of 1.005.)

What we claim is:

1. A zip fastener made of a monofilament of 200 to 20,000 denier composed of a polymethylene terephthalate containing at least 85 mole% of trimethylene terephthalate, tetramethylene terephthalate or hexamethylene terephthalate as a recurring unit, said monofilament having an intrinsic viscosity of 0.35 to 3.5, a circularity of not more than 1.01, and being in a zig-zag or coiled form.

2. The zip fastener of claim 1, made of a monofilament of 500 to 20,000 denier composed of polytetramethylene terephthalate, said monofilament having an intrinsic viscosity of 0.6 to 2.

* * * * *